US010227978B2

(12) United States Patent
Sakakihara et al.

(10) Patent No.: US 10,227,978 B2
(45) Date of Patent: Mar. 12, 2019

(54) LIQUID TRANSPORT DEVICE WITH DECREASING ECCENTRICITY OF THE ROTOR

(71) Applicant: HEISHIN Ltd., Hyogo (JP)

(72) Inventors: Noriaki Sakakihara, Kobe (JP); Eiji Uetsuji, Kobe (JP)

(73) Assignee: HEISHIN Ltd., Hyogo (JP)

( * ) Notice: Subject to any disclaimer, the term of this patent is extended or adjusted under 35 U.S.C. 154(b) by 0 days.

(21) Appl. No.: 15/947,785

(22) Filed: Apr. 7, 2018

(65) Prior Publication Data

US 2018/0223838 A1 Aug. 9, 2018

Related U.S. Application Data

(62) Division of application No. 15/525,494, filed as application No. PCT/JP2015/074716 on Aug. 31, 2015.

(30) Foreign Application Priority Data

Nov. 14, 2014 (JP) ..... 2014-231992

(51) Int. Cl.
*F04C 2/08* (2006.01)
*F04C 2/107* (2006.01)

(52) U.S. Cl.
CPC ..... *F04C 2/107* (2013.01); *F04C 2/084* (2013.01); *F04C 2/1075* (2013.01); *F04C 2240/20* (2013.01)

(58) Field of Classification Search
CPC ..... F04C 2240/20; F04C 2240/10; F04C 15/0065; F04C 2/107
See application file for complete search history.

(56) References Cited

U.S. PATENT DOCUMENTS 9,869,126 B2 1/2018 Evans
2005/0169779 A1 8/2005 Bratu
(Continued)

FOREIGN PATENT DOCUMENTS

CN 1654823 A 8/2005
CN 101484703 A 7/2009
(Continued)

OTHER PUBLICATIONS

International Search Report for corresponding International Application No. PCT/JP2015/074716 dated Nov. 17, 2015.
(Continued)

*Primary Examiner* — Mary Davis
(74) *Attorney, Agent, or Firm* — Renner Otto Boisselle & Sklar, LLP

(57) ABSTRACT

The present invention comprises: a stator 2 that is cylindrical and has a through hole 10, the through hole 10 in the shape of a female screw and being formed at a certain pitch in the flow direction from an inlet to an outlet; and a rotor 3 that is formed in the shape of a male screw, is inserted into the through hole 10 of the stator 2 to form a transport space 11 with the inner circumferential surface of the through hole, and rotates to move a fluid from the inlet to the outlet through the transport space 11 while being inscribed on the inner circumferential surface. The volume of the transport space 11 is reduced toward the flow direction. This prevents, reliably, the occurrence of bubbles from a fluid at a downstream-side when the fluid is transported through the transport space 11 formed between the stator 2 and the rotor 3.

2 Claims, 5 Drawing Sheets

(56) References Cited

U.S. PATENT DOCUMENTS

| | | | | |
|---|---|---|---|---|
| 2009/0226336 | A1 | 9/2009 | Murrow et al. | |
| 2010/0040498 | A1 | 2/2010 | Akamatsu et al. | |
| 2011/0305589 | A1 | 12/2011 | Daunheimer et al. | |
| 2017/0227008 | A1 * | 8/2017 | Dmitriev | F04C 15/0061 |

FOREIGN PATENT DOCUMENTS

| | | | | | |
|---|---|---|---|---|---|
| GB | 770642 | A | * | 3/1957 | D06F 47/06 |
| JP | 2008223492 | A | | 9/2008 | |
| JP | 2010-001876 | A | | 1/2010 | |
| JP | 2010-248979 | A | | 11/2010 | |
| JP | 5388187 | B2 | | 1/2014 | |
| TW | 405658 | | | 9/2000 | |
| WO | WO 2008000506 | | | 1/2008 | |
| WO | WO 2011155311 | A1 | | 12/2011 | |

OTHER PUBLICATIONS

Decision to Grant, and English translation, for corresponding Japanese Patent Application No. JP 2014-231992, dated Jun. 19, 2015.
Notification of Reasons for Refusal, and English translation, for corresponding Japanese Patent Application No. JP 2014-231992, dated Feb. 17, 2015.

* cited by examiner

LIQUID TRANSPORT DEVICE WITH DECREASING ECCENTRICITY OF THE ROTOR

This is a divisional application of U.S. application Ser. No. 15/525,494 with a filing date of May 9, 2017, which is a national phase application in the United States of International Patent Application No. PCT/JP2015/074716 with an international filling date of Aug. 31, 2015, which claims priority from Japanese Patent Application No. 2014-231992 filed on Nov. 14, 2014, the disclosures of which are incorporated herein by reference in their entireties.

The present invention relates to a fluid transport device.

BACKGROUND ART

There has conventionally been known a fluid transport device embodied as a uniaxial eccentric screw pump. The uniaxial eccentric screw pump includes a stator having a tubular shape and provided with a through hole in a female screw shape, and a rotor having a male screw shape, inserted through the through hole of the stator to form a transport space between the rotor and an inner circumferential surface of the through hole, and configured to rotate to shift the transport space from an inlet port side to a discharge port side. The through hole of the stator has interference formed by an elastic deformation thereof due to the rotor being pressed to the stator, and the interference is smaller on the discharge port side than on the inlet port side (see JP 5388187 B1, for example).

The conventional fluid transport device may have the following problem in a case where fluid is highly volatile or contains a large amount of dissolved gas. In a case where the transport space is larger on a downstream side than on an upstream side in a transport direction due to dimensional tolerance or the like, the transport space may have negative pressure to cause the fluid to generate bubbles. Specifically, when the fluid is a highly volatile liquid, vaporization causes generation of the bubbles, and when the fluid contains a large amount of dissolved gas, oversaturation causes generation of the bubbles. Once fluid generates bubbles, the fluid involves defectives in such usages as application and coating due to the bubbles.

SUMMARY OF THE INVENTION

Problem to be Solved by the Invention

It is an object of the present invention to reliably prevent generation of bubbles from fluid being transported by a transport space formed between a stator and a rotor.

Means for Solving the Problem

In order to achieve the object mentioned above, the present invention provides a fluid transport device including:

a stator having a tubular shape and provided with a through hole in a female screw shape having predetermined pitches in a flow direction from an inlet port to a discharge port; and a rotor having a male screw shape, inserted through the through hole of the stator to form a transport space between the rotor and an inner circumferential surface of the through hole, and configured to rotate to be in contact with the inner circumferential surface to shift fluid from the inlet port to the discharge port in the transport space, in which a capacity of the transport space is decreased in the flow direction.

This configuration, in which the transport space is decreased in capacity in the flow direction of the fluid, causes the fluid to be constantly pressurized during transport. In this case, the flow space does not have negative pressure and the fluid does not generate bubbles.

The capacity of the transport space may be decreased by decrease in pitches of the female screw shape of the through hole of the stator and the male screw shape of the rotor.

The capacity of the transport space may be decreased by decrease in sectional area of the through hole of the stator.

The capacity of the transport space may be decreased by increase in diameter of the rotor.

The capacity of the transport space may be decreased by decrease in eccentricity of the rotor.

Preferably, a decrease rate of the pitches of the female screw shape of the through hole of the stator and the male screw shape of the rotor, a decrease rate of the sectional area of the through hole of the stator, an increase rate of the diameter of the rotor, or a decrease rate of the eccentricity of the rotor is not less than dimensional tolerance.

Effect of the Invention

According to the present invention, the transport space is decreased in capacity in the flow direction of the fluid, which makes it possible to reliably prevent the flow space from having negative pressure to generate bubbles from the fluid.

BRIEF DESCRIPTION OF THE DRAWINGS

The foregoing and the other feature of the present invention will become apparent from the following description and drawings of an illustrative embodiment of the invention in which.

MODES FOR CARRYING OUT THE INVENTION

An embodiment of the present invention will be described below with reference to the accompanying drawings. The following description is merely exemplary, and will not limit the present invention, those to which the present invention is applicable, or purposes of use thereof. The drawings depict schematic images without actual dimensional ratios and the like.

Figure 1:
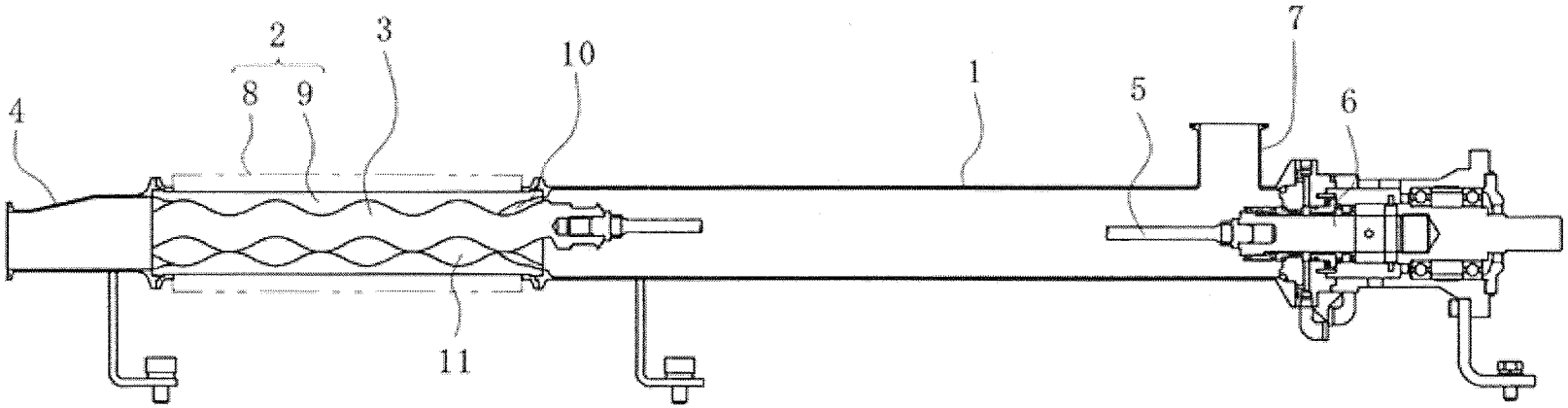
FIG. 1 is a schematic sectional view of a uniaxial eccentric screw pump according to an embodiment of the present invention.

FIG. 1 depicts a uniaxial eccentric screw pump according to the present embodiment. The uniaxial eccentric screw pump includes a driving device (not depicted) provided at one end of a casing 1, as well as a stator 2, a rotor 3, and an end stud 4 provided at the other end thereof.

The casing 1 is made of a metal material formed into a tubular shape, and accommodates a coupling rod 5. The coupling rod 5 has one end connected to a coupling 6 so that motive power from the driving device is transmitted. The one end of the casing 1 has an outer circumferential surface connected with a connecting tube 7 so that fluid can be supplied from a tank or the like (not depicted).

The stator 2 includes an outer cylinder 8, and a stator body 9 disposed in tight contact with an inner surface of the outer cylinder 8.

The outer cylinder 8 is made of a metal material formed into a tubular shape.

The stator body 9 is made of an elastic material such as rubber or resin appropriately selected in accordance with a transport target object (e.g. silicone rubber, or fluororubber for cosmetics containing silicone oil) formed into a tubular (e.g. circular cylindrical) shape. The stator 2 has a center hole 10 having an inner circumferential surface in a female screw shape with n threads and single or multiple steps.

The rotor 3 is a metal shaft body having a male screw shape with n-1 threads and single or multiples steps. The rotor 3 is disposed in the center hole 10 of the stator 2 to form a transport space 11 continuously extending in a longitudinal direction of the center hole 10. The rotor 3 has one end coupled to the coupling rod 5 in the casing, and spins in the stator 2 and revolves along the inner circumferential surface of the stator 2 with driving force from the driving device (not depicted). Specifically, the rotor 3 eccentrically rotates in the center hole 10 of the stator 2 to transport a target object in the transport space 11 in the longitudinal direction.

The center hole 10 in the stator body 9 and the outline of the rotor 3 are shaped in the following manners.

Figure 2A:
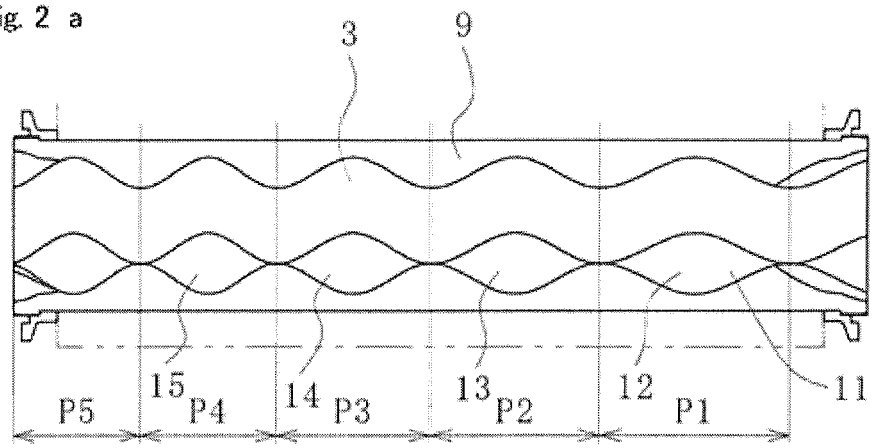
FIG. 2*a* is a partial schematic sectional view of a uniaxial eccentric screw pump according to a first embodiment.
Figure 2B:
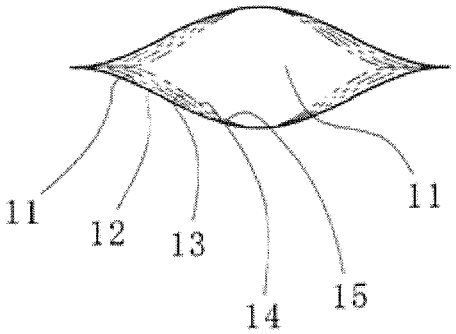
FIG. 2*b* is a view of a first sub transport space and other sub transport spaces overlapped therewith.
Figure 3A:
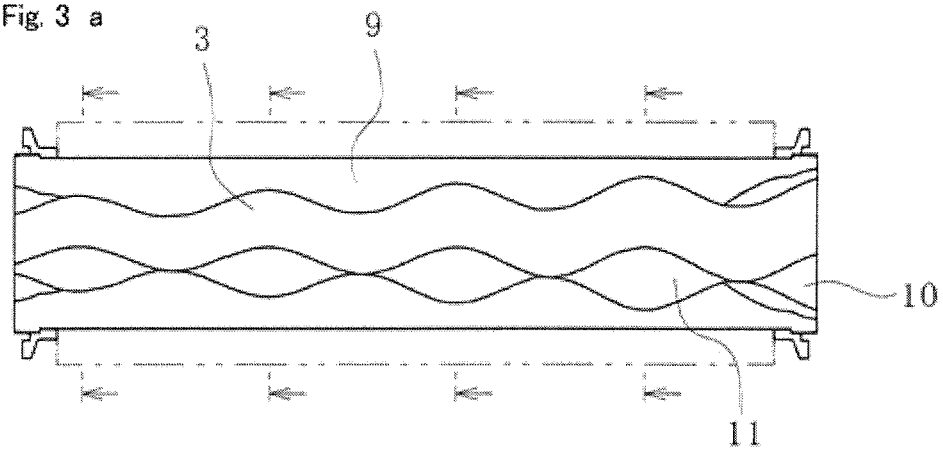
FIG. 3*a* is a partial schematic sectional view of a uniaxial eccentric screw pump according to a second embodiment.
Figure 3B:
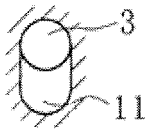
FIGS. 3*b* to 3*e* are sectional views of respective portions thereof.
Figure 3C:
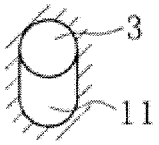
Figure 3D:
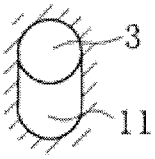
Figure 3E:
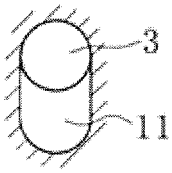
Figure 3F:
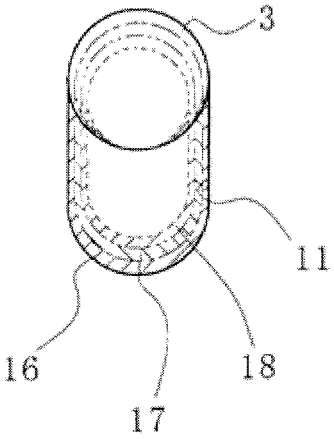
FIG. 3*f* is a view including FIG. 3*e* and FIGS. 3*b* to 3*d* overlapped therewith.

FIGS. 2 depicts a state where the female screw shape of the through hole of the stator 2 and the male screw shape of the rotor 3 have pitches gradually decreased in the transport direction (leftward in the figure) of the fluid. The pitches change from P1 to P5 in this case (P1>P2>P3>P4>P5). FIG. 2*b* is a projection of a first sub transport space 12 depicted in FIG. 2*a* overlapped with a second sub transport space 13, a third sub transport space 14, and a fourth sub transport space 15. As apparent from this figure, the transport space 11 occupies a gradually decreased capacity as the pitches decreases in the transport direction.

FIGS. 3 depicts a state where the transport space 11 provided between the stator 2 and the rotor 3 has a channel sectional area gradually decreased in the transport direction (leftward in the figure) of the fluid. As depicted in FIGS. 3*e* to 3*b*, both the center hole 10 of the stator 2 and the rotor 3 are gradually decreased in size to decrease the channel sectional area, i.e., capacity, of the transport space 11. Specifically, as depicted in the projection of the respective sections in FIG. 3*f*, the sectional area decreases by a portion corresponding to a first region 16 in FIGS. 3*e* and 3*d*, a portion corresponding to a second region 17 in FIGS. 3*d* and 3*c*, and a portion corresponding to a third region 18 in FIGS. 3*c* and 3*b*. The capacity of the transport space 11 can be decreased in the transport direction of the fluid alternatively by gradually decreasing only an open area of the center hole 10 in the stator 2 with the rotor 3 being unchanged in size. FIG. 3 assumes that the rotor 3 is located at an identical position for easier depiction, but the rotor 3 is actually located at different positions in different sections.

Figure 4A:
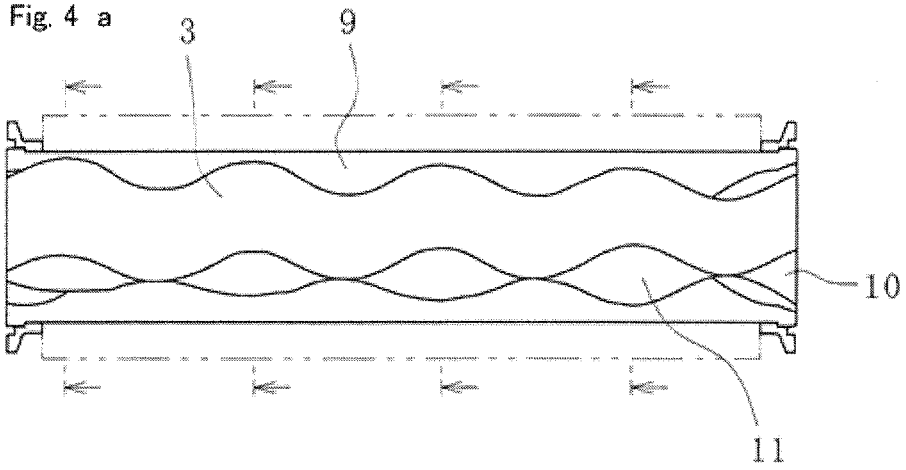
FIG. 4*a* is a partial schematic sectional view of a uniaxial eccentric screw pump according to a third embodiment.
Figure 4B:
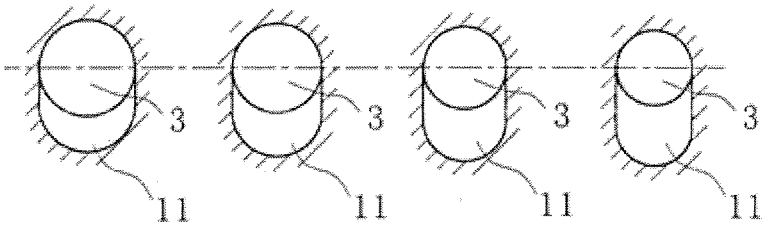
FIG. 4*b* is a sectional view of respective portions thereof.

FIG. 4 depicts a state where the rotor 3 is gradually increased in size (rotor diameter) in the transport direction (leftward in the figure) of the fluid. The center hole 10 of the stator 2 is accordingly changed in shape, but has a sectional area unchanged at each position in the transport direction. The center hole 10 thus has a large diameter according to the rotor diameter but is short in the longitudinal direction (in the vertical direction in FIG. 4*b*), so that the entire transport space 11 has a small sectional area. In other words, the transport space 11 is gradually decreased in capacity in the transport direction. The capacity of the transport space 11 can be decreased in the transport direction alternatively by increasing only the size (diameter) of the rotor 3 with the stator 3 being unchanged in shape. The configuration depicted in FIG. 4 can be regarded as a modification example of decrease in channel sectional area in the transport direction. Similarly to FIG. 3, FIG. 4 assumes that the rotor 3 is located at an identical position for easier depiction, but the rotor 3 is actually located at different positions in different sections.

Figure 5A:
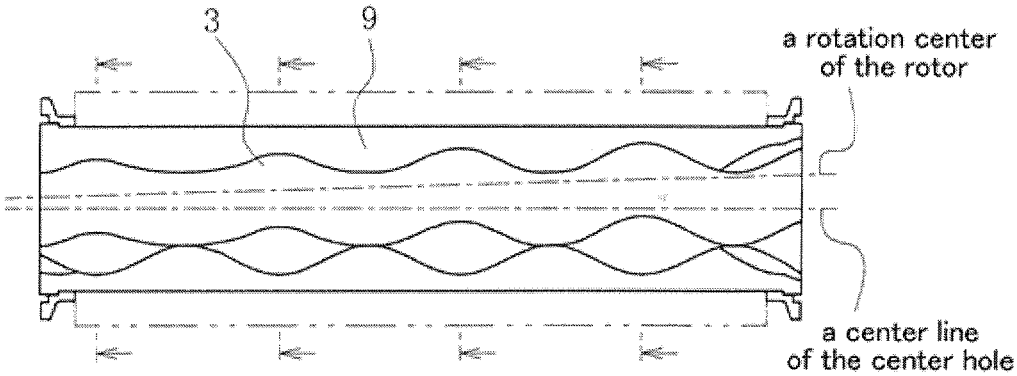
FIG. 5*a* is a partial schematic sectional view of a uniaxial eccentric screw pump according to a fourth embodiment.
Figure 5B:
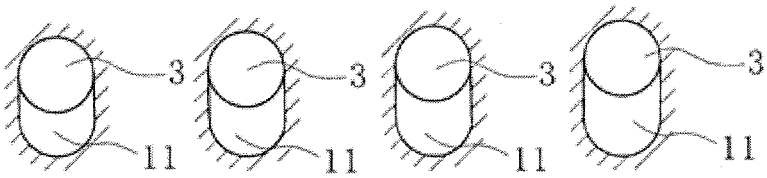
FIG. 5*b* is a sectional view of respective portions thereof.

FIG. 5 depicts a state where the rotor 3 is decreased in eccentricity in the transport direction (leftward in the figure) of the fluid. Specifically, the rotor 3 has a rotation center gradually approaching a center line of the center hole 10 of the stator 2 in the transport direction. The center hole 10 is thus gradually decreased in longitudinal dimension (in the vertical direction in FIG. 5*b*) to cause decrease in sectional area rate of the transport space 11. In other words, the transport space 11 is gradually decreased in capacity in the transport direction.

Next, the behavior of the uniaxial eccentric screw pump thus configured will be described.

Upon discharge of fluid from a tank or the like, the driving device (not depicted) is driven to rotate the rotor 3 via the coupling 6 and the coupling rod 5. This rotation causes shift in the longitudinal direction of the transport space 11 formed between the inner circumferential surface of the stator 2 and the outer circumferential surface of the rotor 3. The fluid discharged from the tank is then sucked into the transport space 11 and is transported to the end stud 4. The fluid having reached the end stud 4 is further transported to a different site.

In any one of the configurations depicted in FIGS. 2 to 5, the transport space 11 is gradually decreased in capacity toward the downstream end in the transport direction. These configurations cause the transported fluid to be constantly pressurized. This reliably prevents the transport space 11 from having negative pressure to prevent generation of bubbles in the fluid. The transported fluid will thus generate no bubbles. The fluid used for application, coating, and the like will not cause deterioration in appearance or in quality with no bubbles appearing on an applied surface or a coating surface.

The present invention is not limited to the embodiment described above, but includes various modifications.

For example, the configurations depicted in FIGS. 2 to 5 are adopted for gradual decrease in capacity of the transport space 11 in the transport direction. Any of these configurations can be combined appropriately. For example, the rotor 3 and the stator 2 may have pitches decreased in the transport direction and the channel sectional area may be decreased.

The above embodiment does not particularly refer to a capacity decrease rate of the transport space 11 in the transport direction. A preferred configuration causes the capacity to be reliably decreased even in consideration of dimensional tolerance of constituent parts. In this case, a decrease rate of the pitches of the female screw shape of the center hole 10 of the stator 3 and the male screw shape of the rotor 2, a decrease rate of the sectional area of the center hole 10 of the stator 3, an increase rate of the diameter of the rotor 2, or a decrease rate of eccentricity of the rotor 2 will be set to be not less than the dimensional tolerance. Generation of bubbles is thus reliably prevented without increase in capacity of the transport space in the transport direction due to the dimensional tolerance.

The above embodiment exemplifies the configurations for transporting fluid without generation of bubbles. The present invention can also include the following configuration. The rotor 3 is rotated reversely to cause the fluid to be transported from the left to the right in FIG. 1 (reversed from the transport direction in the above embodiment). The transport space 11 is then enlarged in the transport direction to constantly have negative pressure. The transport space can thus function as a degassing device configured to exhaust gas dissolved in the fluid as bubbles.

INDUSTRIAL APPLICABILITY

The present invention is applicable to a device configured to transport fluid while simultaneously pressurizing or depressurizing the fluid.

DESCRIPTION OF SYMBOLS

Casing
Stator
Rotor
End stud
Coupling rod
Coupling
Connecting tube
Outer cylinder
Stator body
Center hole (Through hole)
Transport space
First sub transport space
Second sub transport space
Third sub transport space
Fourth sub transport space
First region
Second region
Third region

The invention claimed is:

1. A liquid transport device comprising:

a stator having an outer cylinder and a stator body disposed in tight contact with an inner surface of the outer cylinder and provided with a through hole in a female screw shape having predetermined pitches in a flow direction from an inlet port to a discharge port; and a rotor having a male screw shape and same rotor diameter with respect to an axis direction, inserted through the through hole of the stator to form a transport space between the rotor and an inner circumferential surface of the through hole, and configured to eccentrically rotate via a coupling rod to be in contact with the inner circumferential surface to shift fluid from the inlet port to the discharge port in the transport space, wherein a capacity of the transport space is decreased in the flow direction by decrease in eccentricity of the rotor.

2. The liquid transport device according to claim 1, wherein a decrease rate of the eccentricity of the rotor is greater than or equal to dimensional tolerance.

* * * * *